US006526888B2

(12) United States Patent
Douillard et al.

(10) Patent No.: US 6,526,888 B2
(45) Date of Patent: Mar. 4, 2003

(54) REDUCED VIBRATION PRINTING PRESS AND METHOD

(75) Inventors: Gerald Roger Douillard, Epping, NH (US); Mark Bernard Dumais, Kennebuck, ME (US); Michael Thomas Woroniak, Dover, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 42 days.

(21) Appl. No.: 09/727,994

(22) Filed: Dec. 1, 2000

(65) Prior Publication Data

US 2002/0066379 A1 Jun. 6, 2002

(51) Int. Cl.[7] ..... B41F 31/00; B41F 1/66

(52) U.S. Cl. ..... 101/484; 101/220; 101/350.3; 101/DIG. 38

(58) Field of Search ..... 101/220, 219, 101/348, 216, 217, 212, 142, 177, 183, 350.3, 351.1, 352.09, 483, 484, DIG. 38

(56) References Cited

U.S. PATENT DOCUMENTS 5,003,874 A * 4/1991 Junghans
5,309,833 A * 5/1994 Guaraldi ..... 101/226
5,524,538 A * 6/1996 Voge et al. ..... 101/142
5,596,931 A * 1/1997 Rössler et al. ..... 101/484
5,845,576 A * 12/1998 Junghans ..... 101/484
5,988,063 A * 11/1999 Brandenburg et al. ..... 101/219
6,227,113 B1 * 5/2001 Dorenkamp ..... 101/350.3

FOREIGN PATENT DOCUMENTS

| | | |
|---|---|---|
| GB | 2180502 | 4/1987 |
| JP | 8276562 | 10/1996 |

* cited by examiner

*Primary Examiner*—Eugene H. Eickholt
(74) *Attorney, Agent, or Firm*—Davidson, Davidson & Kappel, LLC

(57) ABSTRACT

A method for reducing vibrations in a printing press, the printing press having a first plate cylinder independently registrable from a second print cylinder. The method includes the steps of determining a lateral position of the first vibrator, roll with respect to the second vibrator roll and rotating the first plate cylinder with respect to the second plate cylinder so as to change the lateral position of the first vibrator roll with respect to the second vibrator roll. A printing press has a controller receiving an input from at least one sensor, the controller rotating the first plate cylinder with respect to the second plate cylinder so as to alter a phase between the first vibrator roll and the second vibrator roll as a function of the input.

17 Claims, 2 Drawing Sheets

REDUCED VIBRATION PRINTING PRESS AND METHOD

BACKGROUND OF THE INVENTION

1. Field of the Invention

The present invention relates generally to printing presses and more particularly to a printing press for operating with reduced vibrations.

2. Background Information

Print unit towers have significant side frame vibration while starting up and during operation. One of the major causes of side frame vibration are vibrator rolls, which move laterally so as to provide a more consistent ink coating or dampening solution to a plate cylinder. The vibrations caused by the vibrator rolls may reduce the life of the equipment and also may cause a lateral print double on the printed material, leading to poor print quality and, often, paper waste.

Prior attempts to reduce vibrator roll vibration effects include using a separate motor to drive the lateral motion of the vibrator rolls so that the torque disturbances due to vibrator oscillation can be insulated from the unit drive, or to drive the lateral motion so that vibrator phases can be adjusted relative to one another.

However, using separate motors to drive the vibrator rolls to produce the lateral motion incurs significant additional cost and complexity over the traditional technique of having the lateral and rotational motion of the vibrator rolls driven by the same drive which drives the printing cylinders.

When the lateral motion is driven by the same drive as a corresponding print cylinder, the phasing of the various vibrator rolls for different plate cylinders typically are not controlled, especially if independent motors drive the various plate cylinders. If, for example, during a circumferential registration adjustment of one plate cylinder, the phase of the various vibrator rolls changes, those vibrator rolls may cause increased vibrations, leading to the defects mentioned above.

Japanese Patent Document No. 8-276562 purports to disclose a dynamic dampener for reducing vibrations caused by a reciprocating roller. The dynamic dampener requires a separate device, which can be expensive and can be difficult to maintain.

U.K. Patent Application No. 2 180 502 purports to disclose a device for adjusting the amplitude of the axial reciprocation of ink vibrator rollers. No change in the phasing of the axial reciprocation appears to occur, and the purpose of the device does not appear to be to reduce vibrations in a printing press, but rather to vary the stroke length of the vibrator rollers.

BRIEF SUMMARY OF THE INVENTION

An object of the present invention is to provide a method and device for reducing printing press vibrations in an efficient or cost-effective manner.

The present invention provides a method for reducing vibrations in a printing press having a first plate cylinder independently registrable from a second print cylinder. The first plate cylinder is operatively connected to at least one first laterally-moving vibrator roll and the second plate cylinder is operatively connected to at least one second laterally-moving vibrator roll. The method includes the steps of determining a lateral position of the first vibrator roll with respect to the second vibrator roll, and rotating the first plate cylinder with respect to the second plate cylinder so as to change the lateral position of the first vibrator roll with respect to the second vibrator roll.

By changing the lateral position of the first vibrator roll with respect to the second vibrator roll, and thus the phase between the vibrator rolls, a desired phase difference between the rolls corresponding to operation of the printing press at reduced vibrations can be achieved.

The rotating step preferably includes rotating either the first or second plate cylinder in a single rotation of 360 degrees, or a plurality of single rotations of 360 degrees.

Preferably, a desired phase difference between the first and second vibrator rolls is determined, with the rotating step including rotating the first or second plate cylinder a number of rotations to achieve the desired phase difference.

A lateral position of the first vibrator roll may be fed back to a controller, the controller then controlling the rotating step.

The desired phase difference may be determined using a mathematical model, or by measuring actual vibrations in the press.

If the first and second rolls are at a same height, the first vibrator roll preferably is phased, based on the mathematical model, at 180 degrees from the second vibrator roll after the rotating step.

The present invention also provides a method for reducing vibrations in the printing press comprising the steps of determining a desired lateral position of the first vibrator roll with respect to the second vibrator roll as a function of actual or predicted vibration of the printing press, and rotating the first plate cylinder with respect to the second plate cylinder so as to change the lateral position of the first vibrator roll with respect to the second vibrator roll to the desired lateral position.

Also provided by the present invention is a printing press including a first plate cylinder with at least one first vibrator roll operatively connected to the first plate cylinder. The first vibrator roll is part of an inking unit or a dampening unit, and the first vibrator roll moves laterally a certain amount for each rotation of the first plate cylinder. The press also includes a second plate cylinder independently registrable with respect to the first plate cylinder in a circumferential direction, with at least one second vibrator roll operatively connected to the second plate cylinder. The second vibrator roll is part of another inking unit or another dampening unit, with the second vibrator roll moving laterally a certain amount for each rotation of the second plate cylinder. At least one sensor senses a lateral position of the first vibrator roll with respect to the second vibrator roll or a vibration of the printing press, and a controller receives an input from the at least one sensor. The controller then rotates the first plate cylinder with respect to the second plate cylinder so as to alter a phase between the first vibrator roll and the second vibrator roll as a function of the input.

Preferably the printing press is a lithographic offset printing press having a first blanket cylinder connected to the first plate cylinder and a second blanket cylinder connected to the second plate cylinder.

A first motor preferably drives the first plate cylinder and the first vibrator roll and a second motor drives the second plate cylinder and the second vibrator roll.

At least two first vibrator rolls and at least two second vibrator rolls preferably are present, with at least one being for the inking unit and at least one for the dampening unit.

The sensor may include a first sensor to monitor a first vibrator roll lateral position and a second sensor to monitor a second vibrator roll lateral position.

The sensor may be an accelerometer or other device measuring the vibration of the press.

BRIEF DESCRIPTION OF THE DRAWINGS

A preferred embodiment of the present invention is described below by reference to the following drawings, in which.

DETAILED DESCRIPTION OF A PREFERRED EMBODIMENT

Figure 1:
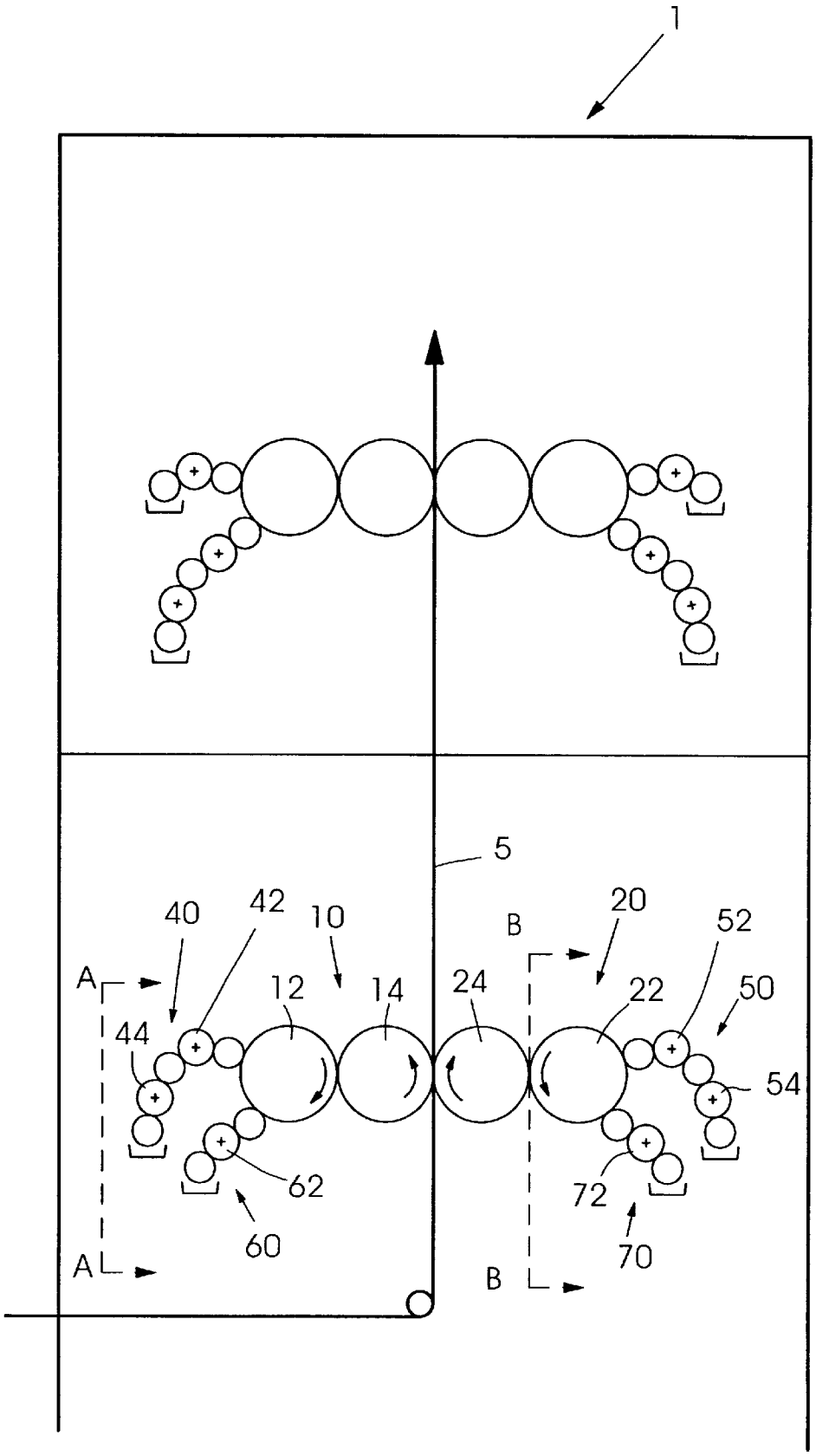
FIG. 1 shows an offset lithographic printing press according to the present invention.

FIG. 1 shows an offset lithographic printing press 1 having a first print couple 10 and a second print couple 20. A web 5 passes between the print couples 10, 20 so as to be printed on both sides. Print couple 10 includes a plate cylinder 12 and a blanket cylinder 14. Plate cylinder 12 preferably includes a flat lithographic printing plate fastened in an axially-extending gap of the plate cylinder 12, although other forms of plate cylinders such as digitally-imaged plate cylinders are possible. Blanket cylinder 14 preferably includes an axially-removable tubular-shaped blanket. Print couple 20 similarly has a plate cylinder 22 and a blanket cylinder 24. Plate cylinder 22 is driven independently from plate cylinder 12.

Figure 2:
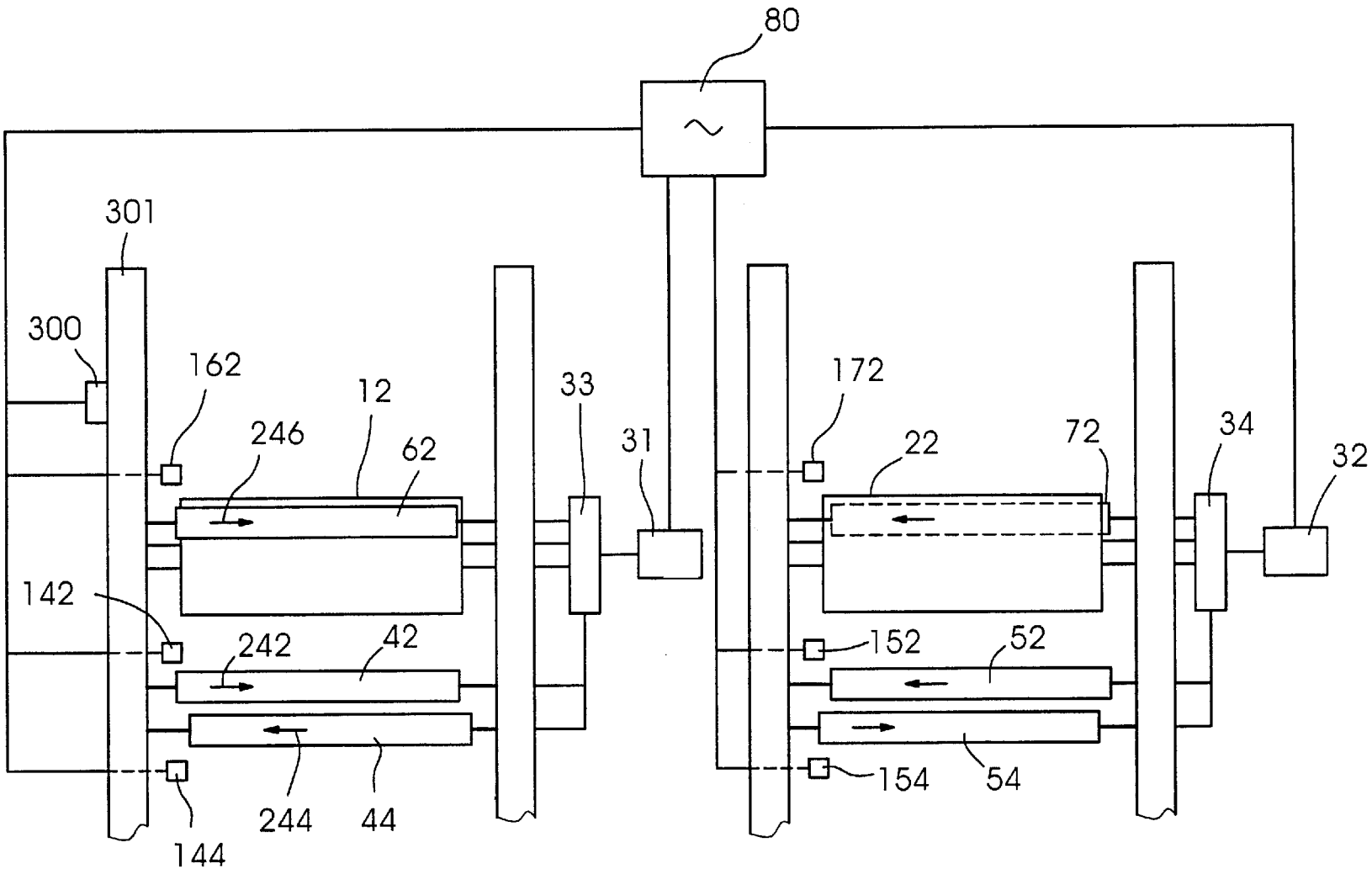
FIG. 2 shows a side view through cuts A—A and B—B of FIG. 1 of the offset lithographic printing press of FIG. 1 in side view, with various non-vibrating (non-reciprocating) rollers removed to aid clarity.

FIG. 2 shows views of printing press 1 through cross sections A—A and B—B as shown in FIG. 1, with only the vibration rollers of the inking and dampening units shown to improve clarity. A motor 31 and gearing 33 may drive plate cylinder 12, and blanket cylinder 14, while a second independent motor 32 drives plate cylinder 22, gearing 34 and blanket cylinder 24. Plate cylinders 12 and 22 thus also may be independently registered in a circumferential direction, for example, by the respective motors 31, 33. While a two motor configuration has been disclosed, other alternate embodiments where the plate cylinder 12 is independently registerable from plate cylinder 22 are possible, for example a three motor configuration where the plate cylinder 12 is driven by one motor, the two blanket cylinders 14 and 24 are driven by a second motor, and the plate cylinder 22 by a third motor. A single motor configuration is also possible, with for example helical gearing for altering a phase between the plate cylinders 12 and 22.

As shown in FIG. 1, printing press 1 also includes a first inking unit 40 and a first dampening unit 60 for plate cylinder 12, and second inking unit 50 and a second dampening unit 70 for plate cylinder 22. The inking units 40, 50 provide ink from a fountain to the plate cylinders 12, 22, respectively, while the dampening units 60, 70 provide dampening solution. In a lithographic process, the images on the plates of plate cylinders 12, 22 are transferred to the blanket cylinders 14, 24, respectively, the images then being transferred to both sides of web 5.

Inking unit 40 has a first vibrator roll 42 and a second vibrator roll 44, which both rotate and move laterally when the plate cylinder 12 rotates. Inking unit 40 is driven by motor 31, so that plate cylinder 12 and vibrator rolls 42 and 44 are geared together through gearing 33. For example, the vibrator rolls 42, 44 are geared so that the for each rotation of cylinder 12, the vibrator rolls 42, 44 move, for example, 0.154 strokes laterally (axially). A stroke is defined as a full forward and back lateral movement of the rollers, and stroke length is defined as the zero to maximum distance. Also, one stroke constitutes a 360 degree movement. Thus in this example after a little more than six and a half rotations of the plate cylinder 12, the vibrator rolls 42, 44 move laterally a full stroke, returning to a same position. Preferably, a single rotation of the plate cylinder 12 causes roll 42 to move laterally by a number of degrees ND so that 360 divided by ND does not equal an integer. Thus an infinite number of phase angles between roll 42 and roll 52 may be achieved. However, if 360 divided by ND is an integer, the integer preferably is greater than 2.

Inking unit 40 also has other inking rolls which do not vibrate laterally, but merely rotate. The lateral vibration of rolls 42, 44 aids in providing an evenly distributed ink film to the plate cylinder 12.

The vibrator rolls 42, 44 may be of equal mass (for example about 60 kg), have stroke length of about 19 mm, and are phased 120 degrees with respect to one another, and with a dampening vibrator roller 62. In other words, the vibrator rolls, 42, 44 and the dampening vibrator roll 62 move in varying directions, as shown by arrows 242, 244 and 246. However, since the vibrators rolls 42, 44 and 62 are at different heights, and may have different weights or stroke lengths, a net vibration likely will result from the movement of the three vibrator rolls 42, 44, 62.

A dampening unit 60 for plate cylinder 12 also has the single vibrator roll 62, which aids in evenly distributing dampening solution (such as water) to the plate cylinder 12. Other dampening vibrator or non-vibrator rolls may be provided in the dampening unit 60. Vibrator roll 62 also is geared to the motor 31 which drives plate cylinder 12, and is geared so as to move 120 degrees with respect to the lateral movement of each of the vibrator rolls 42, 44. The distance of the lateral stroke, and the weight, of roll 62 may differ from that of rolls 42, 44. For example, the roll 62 may weigh 61 kilograms and have a fixed stroke length of 19 mm. The stroke length of the rolls 42, 44 may be variable.

Inking unit 50 and dampening unit 70 for second plate cylinder 22 also have vibrating rolls 52, 54, and 72, respectively. These vibrator rolls 52, 54 and 72 are geared through gearing 34 to the drive motor 32 for plate cylinder 22. Preferably, the rolls 52, 54 and 72 are phased 120 degrees from one another.

The roll 52 is preferably phased 180 degrees from roll 42, with roll 54 thus being phased 180 degrees from roll 44 and roll 62 phased 180 degrees from roll 72. Since the height of rolls 52 and 42 is similar, the height of rolls 54 and 44 are similar, and the height of rolls 72 and 62 are similar, according to mathematical models this counterphasing generally should minimize vibrations. The rolls 52, 54, 72 thus move in opposite directions from rolls 42, 44 and 62.

Sensors 142, 144, 152, 154, 162 and 172 can sense a lateral position of respective rolls 42, 44, 52, 54, 62, 72. The sensors preferably are proximity sensors. If vibrator rolls 52, 54 and 72 are geared together, a single sensor 172 can be provided for the inking unit 50 and dampening unit 70. If vibrator rolls 42, 44, and 62 are geared together a single sensor 162 also can be provided for determining the lateral position of rolls 42, 44 and 62.

Depending on the construction of the printing press and the location, namely the height, of the vibrator rolls 42, 44, 52, 54, 62, 72, a desired phase difference between the first vibrator rolls 42, 44 and 62 and the second vibrator rolls 52, 54, 72 can be determined. The desired phase difference can be based on a mathematic prediction, or by actual test results. For example, if the height, weight and stroke length of rolls 42 and 52, rolls 44 and 54 and rolls 62 and 72 similar, it can be predicted that a phase difference of 180 degrees between the rolls would minimize vibration, as roll 42 would move in the opposite direction of roll 52, roll 44 in the opposite direction of roll 55, and roll 62 in the opposite direction of roll 72. Mathematical modeling can also be used to determine a predicted desired phase difference between the rolls 42 and 52 even if the rolls are at different heights, for example. For example, a net forcing moment M due to 24 vibrators in an eight print couple tower could be modeled as M equals the sum from i=1 to 24 of the following: $w^2*s_i*d_i*m_i*\sin(w*t+f_i)$, where w is the vibrator frequency, f is the phase of the vibrator relative to a reference, m is the mass of the vibrator, d is the distance to ground from the centroid of the vibrator, and s is the amplitude of the vibrator stroke. Since the phase f for one set of vibrators for a particular plate cylinder is related, the and if the phase for one set of vibrators varies by a constant phase difference df from a second set of vibrators, an optimal phase difference df can be determined in which the net forcing moment is minimized.

Alternately, an accelerometer, preferably a zero frequency accelerometer, or other sensor could be used to receive actual data on the vibrations generated in the press 1 as a function of phase differences between the rolls 42 and 52. A vibration sensor 300 can be placed on a frame 301 of printing press 1 to measure the vibrations. A desired phase difference thus can be determined corresponding to a minimized vibration of the press 1.

Printing press 1 also includes a controller 80 receiving inputs from sensors 142, 144, 152, 154, 162, 172 and also controlling the press drive and motors 31 and 32. Controller 80 may include one or more processors, for example, INTEL PENTIUM processors. Motor 31 drives plate cylinder 12, and thus controller 80 can set a circumferential register for plate cylinder 12 through motor 31, The circumferential register for plate cylinder 22 is set through motor 32 and controller 80. In order to alter a phase difference between rolls 42 and 52, one of the plate cylinders 12 or 22 is rotated so as not to alter the circumferential register of the plate cylinder, e.g. a single rotation of 360 degrees, in either a clockwise or counterclockwise direction. For example, plate cylinder 12 can be rotated 360 degrees. Depending on the relationship between the stroke length of roll 42 and the rotation of plate cylinder 12, the roll 42 (and rolls 44 and 62) moves laterally a certain amount, for example 0.154 of a vibrator stroke length. Thus each rotation of cylinder 12 while cylinder 22 remains stationary causes roll 42 to move 55.44 degrees (1 stroke length=360 degrees, so 0.154 stroke length=55.44 degrees) out of phase with respect to roll 52. Before printing, the controller 80 thus can rotate the cylinder 12 a number of single rotations (1, 2, 3, etc.) while cylinder 22 remains stationary so that the desired phase difference between rolls 42 and 52 is achieved.

In an alternate embodiment of the present invention, one or more vibration sensors 110, for example accelerometers, are placed on the frame of the printing press 1. The press 1 is run and tested for the amount of vibration. If the vibration exceeds a desired limit, the phase of the rolls 42 and 52 is altered so as to determine either a minimum vibration or a vibration which falls below the desired limit. The press 1 then may perform a print run.

Plate cylinder as defined herein can include any image cylinder, including for example a digitally-imaged cylinder which does not have a plate.

The desired phase difference as defined herein may be an approximation, for example to bring the press within a desired maximum operating vibration standard. The desired phase difference can thus be set to within an error margin of 6 degrees, for example.

The lateral movements of reciprocating vibration cylinders 42, 44, 52, 54, 62, 72 are shown in an exaggerated manner in FIG. 2 to aid clarity.

While only a single print unit has been described in detail in FIG. 1, it can be seen that another print unit could be stacked over the first print unit. Stacking can reduce the required footprint of the press, but the increasing height of the print units increases the vibrational effect of the vibration rolls. The present invention thus has particular applicability to printing presses with stacked printing units.

What is claimed is:

1. A method for reducing vibrations in a printing press, the printing press having a first plate cylinder independently registrable from a second plate cylinder, the first plate cylinder being operatively connected to at least one first laterally-moving vibrator roll and the second plate cylinder being operatively connected to at least one second laterally-moving vibrator roll, the method comprising the steps of:

determining a lateral position of the first vibrator roll with respect to the second vibrator roll; and rotating the first plate cylinder with respect to the second plate cylinder so as to change the lateral position of the first vibrator roll with respect to the second vibrator roll.

2. The method as recited in claim 1 wherein the rotating step includes rotating either the first or second plate cylinder so that a circumferential register of the first or second plate cylinder is not altered.

3. The method as recited in claim 2 wherein the first or second plate cylinder is rotated a plurality of single rotations of 360 degrees.

4. The method as recited in claim 1 further comprising determining a desired phase difference between the first and second vibrator rolls, the rotating step including rotating the first or second plate cylinder a number of rotations to achieve the desired phase difference.

5. The method as recited in claim 4 further comprising feeding back a lateral position of the first vibrator roll to a controller, the controller controlling the rotating step.

6. The method as recited in claim 4 wherein the determining step is performed using a mathematical model.

7. The method as recited in claim 4 wherein the determining step is performed by measuring actual vibrations.

8. The method as recited in claim 1 wherein the first vibrator roll is phased a 180 degrees from the second vibrator roll after the rotating step.

9. A method for reducing vibrations in a printing press, the printing press having a first plate cylinder independently registrable from a second plate cylinder, the first plate cylinder being operatively connected to at least one first laterally-moving vibrator roll and the second plate cylinder being operatively connected to at least one second laterally-moving vibrator roll, the method comprising the steps of:

determining a desired lateral position of the first vibrator roll with respect to the second vibrator roll as a function of actual or predicted vibration of the printing press; and rotating the first plate cylinder with respect to the second plate cylinder so as to change the lateral position of the first vibrator roll with respect to the second vibrator roll to the desired lateral position.

10. A printing press comprising:

a first plate cylinder;

at least one first vibrator roll operatively connected to the first plate cylinder, the first vibrator roll being part of an inking unit or a dampening unit, the first vibrator roll moving laterally a certain amount for each rotation of the first plate cylinder;

a second plate cylinder independently registrable with respect to the first plate cylinder in a circumferential direction;

at least one second vibrator roll operatively connected to the second plate cylinder, the second vibrator roll being part of another inking unit or another dampening unit, the second vibrator roll moving laterally a certain amount for each rotation of the second plate cylinder;

at least one sensor for sensing at least one of a lateral position of the first vibrator roll with respect to the second vibrator roll and a vibration of the printing press; and a controller receiving an input from the at least one sensor, the controller rotating the first plate cylinder with respect to the second plate cylinder so as to alter a phase between the first vibrator roll and the second vibrator roll as a function of the input.

11. The printing press as recited in claim 10 further comprising a first blanket cylinder connected to the first plate cylinder and a second blanket cylinder connected to the second plate cylinder.

12. The printing press as recited in claim 10 further comprising a first motor driving the first plate cylinder and the first vibrator roll and a second motor driving the second plate cylinder and the second vibrator roll.

13. The printing press as recited in claim 10 wherein the at least one first vibrator roll includes at least two vibrator rolls.

14. The printing press as recited in claim 10 wherein the press is an offset lithographic printing press.

15. The printing press as recited in claim 10 wherein the at least one sensor includes a sensor sensing a first vibrator roll lateral position and a second sensor sensing a second vibrator roll lateral position.

16. The printing press as recited in claim 15 wherein the at least one sensor further includes an accelerometer measuring the vibration.

17. The printing press as recited in claim 10 wherein the at least one sensor includes an accelerometer.

* * * * *